United States Patent [19]

Germann

[11] 4,292,828

[45] Oct. 6, 1981

[54] APPARATUS FOR MANUFACTURING COLD-WORK HARDENED CYLINDERS

[75] Inventor: Willy Germann, Würenlos, Switzerland

[73] Assignee: BBC Brown, Boveri & Company Ltd., Baden, Switzerland

[21] Appl. No.: 1,850

[22] Filed: Jan. 8, 1979

[30] Foreign Application Priority Data

Jan. 25, 1978 [CH] Switzerland ..... 787/78

[51] Int. Cl.[3] ..... B21D 22/10

[52] U.S. Cl. ..... 72/54; 72/58

[58] Field of Search ..... 72/54, 58, 62, 63; 29/421 R

[56] References Cited

U.S. PATENT DOCUMENTS

| | | | |
|---|---|---|---|
| 2,887,146 | 5/1959 | Hesterman | 29/421 R X |
| 3,358,489 | 12/1967 | Hutchins | 72/62 |
| 3,958,437 | 5/1976 | Barorian | 72/62 |

*Primary Examiner*—Leon Gilden

*Attorney, Agent, or Firm*—Burns, Doane, Swecker & Mathis

[57] ABSTRACT

A method and apparatus for expanding cylinders for work hardening, especially for large diameter cylinders and cylinders of great length, are disclosed. The cylinder is clamped between two flanges and a shaft is inserted coaxially through the cylinders and through the flanges to reduce the force applied axially to the flanges while pressure is applied to the interior of the cylinder. Various arrangements for adjusting the position of the flanges to accommodate for expansion of the cylinder are disclosed.

1 Claim, 3 Drawing Figures

APPARATUS FOR MANUFACTURING COLD-WORK HARDENED CYLINDERS

BACKGROUND OF THE INVENTION

This invention relates to metal working, and more particularly to the manufacture of cold-work hardened cylinders.

In certain environments, it is necessary to provide long cylinders of large diameter. For example, a super conductive excitation winding of a tubogenerator is cooled by liquid helium. The cold rotor body which supports the winding is located in an outer cylinder which is warm and non-magnetic. Turbogenerators of this type have a considerable length, and the cylinder in which the winding is located must therefore also be of great length. These long cylinders can be assembled from sections of shorter length, but the sections must be welded together to achieve the desired length. A disadvantage of the welding operation is that the desireable mechanical properties which are achieved by cold-working are lost due to the heat that is applied during the welding operation. This method of assembly is only suitable for cylinders of small diameter that are not subject to high stresses.

It is an object of this invention to provide a method for the manufacture of cold-worked cylinders which is economical and will not adversely affect the mechanical properties of the cylinder, and yet is suitable for cylinders of large diameters and great length.

SUMMARY OF THE INVENTION

In accordance with this invention, the cylinder is clamped between two circular flanges. A shaft passes through central openings in the flanges and through the center of the cylinder. Pressure is applied to the interior of the cylinder between the outer surface of the shaft and the inner wall of the cylinder to stress the cylinder and thereby to cold-work the cylinder and improve its mechanical properties.

DESCRIPTION OF THE DRAWINGS

A preferred embodiment of the invention is illustrated in the accompanying drawings in which.

DESCRIPTION OF PREFERRED EMBODIMENT

Figure 1:
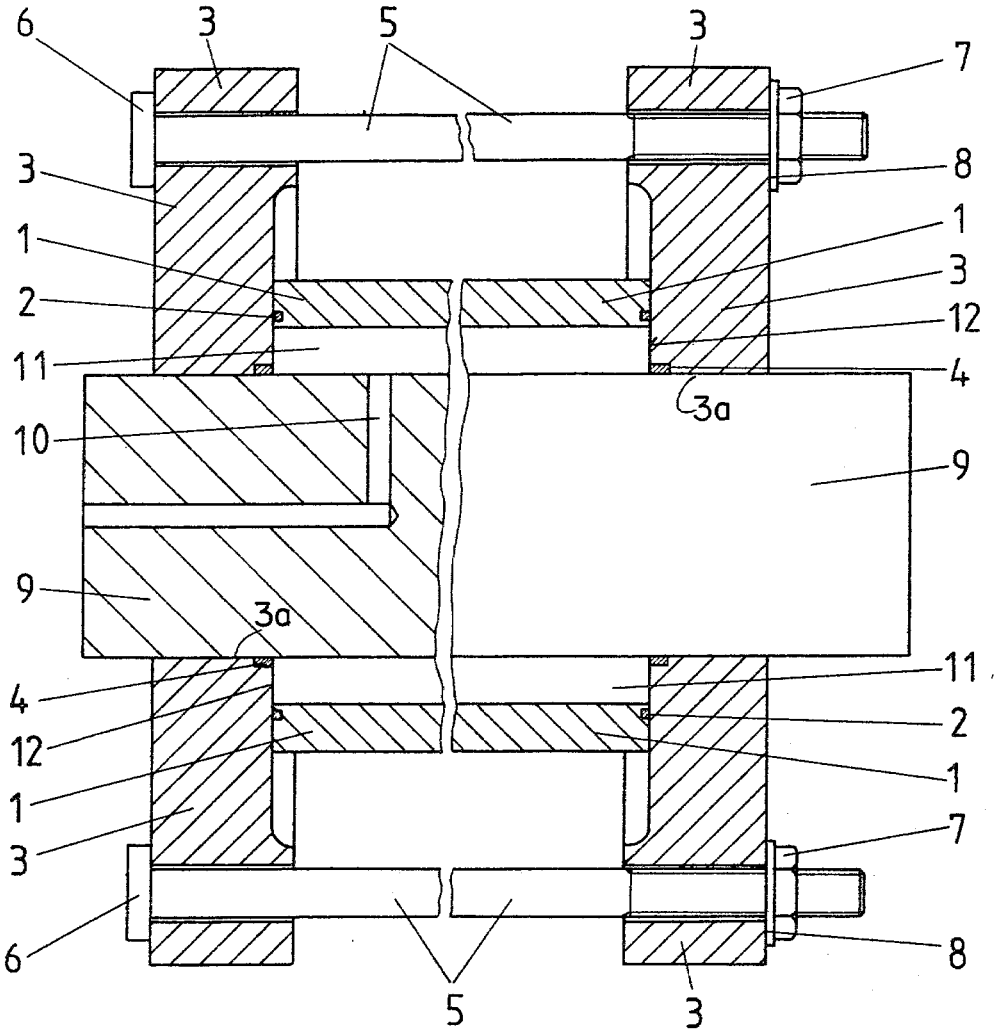
FIG. 1 is a cross-sectional view of the apparatus in accordance with this invention.

As shown in FIG. 1 the apparatus of this invention supports a cylinder 1 which is to be hardened by cold-working. The cylinder 1 is provided with annular seals 2 which are received in grooves in each end of the cylinder 1. Flanges 3 are clamped against the ends of the cylinder 1. The flanges 3 are provided with seals 4 and are held together by bolts 5 which are spaced around the circumference of the flanges 3. The head 6 of each bolt engages one of the flanges 3 while the nut 7 on the bolt engages the other flange 3. Washers 8 are inserted on the bolt 5 between the flange 3 and the nut 7.

The cylinder 1 is positioned concentrically about the central axis of the flanges 3, and a shaft 9 is inserted through central bores 3*a* in the center of each flange 3. Seal rings 4 in the flanges 3 engage the outer surface of the shaft 9. The shaft 9 has a passage 10 for supplying fluid under pressure into the space 11 between the interior wall of the cylinder 1 and the outer surface of the shaft 9. The portion of the flanges 3 which form the wall of the space 11 are designated by the numeral 12.

If the shaft 9 were not inserted in the flanges 3 and the flanges did not have a central opening 3′ for the shaft, then the pressure applied to the interior of cylinder 1 would also be applied across the entire central area of the flanges 3. The resulting force would be the product of the pressure in the space 11 multiplied by the flange area circumscribed by the interior wall of the cylinder 11 at the seal rings 2. By inserting the shaft 9, the surface area exposed to the high pressure in the space 11 is greatly reduced, thereby reducing the tension in the bolts 5. This arrangement, therefore, allows work hardening of relatively large cylinders without requiring massive restraint for the forces developed by the pressure in the interior of the cylinder.

In operation, fluid under pressure is supplied through the passage 10 to the space 11, thereby applying radial stresses to the cylinder 1. In response to the pressure, the cylinder expands and is hardened by the cold-working that occurs in this process. Any shortening of the cylinder 1 that results can be compensated by tightening the nuts 7.

Figure 2:
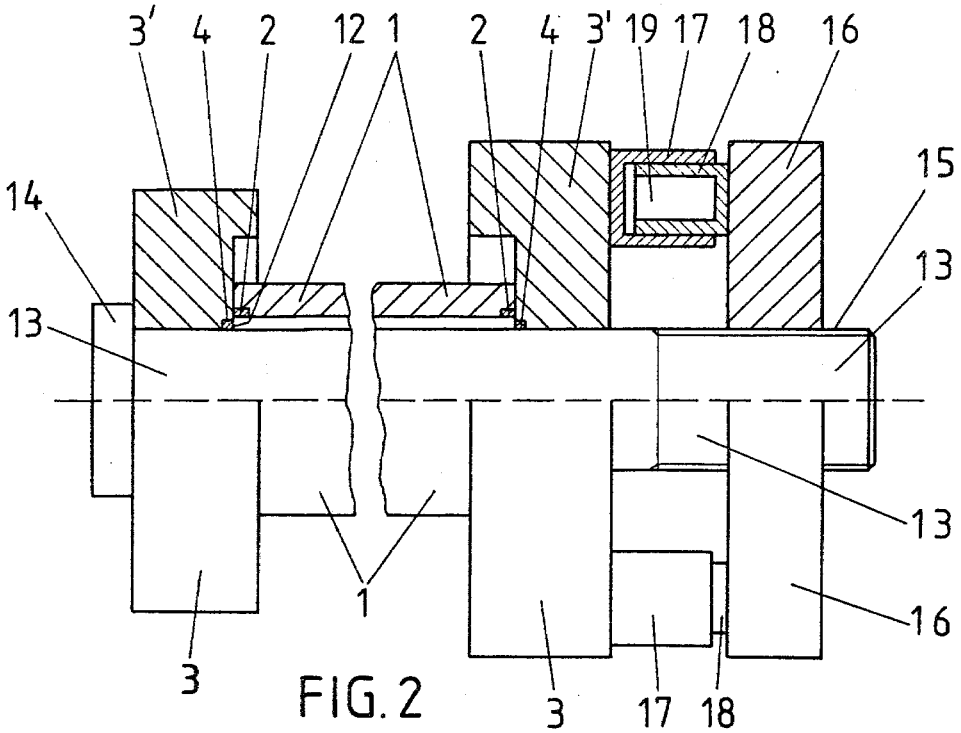
FIG. 2 is an elevational view, partially in cross-section of a modified form of the invention.
Figure 3:
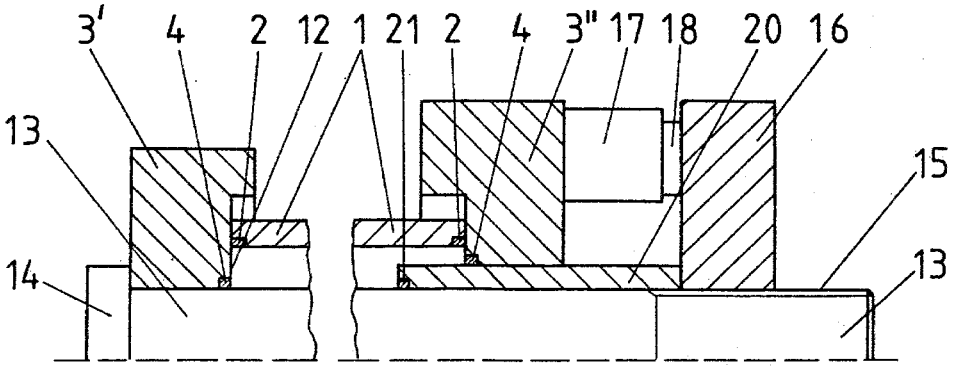
FIG. 3 is a cross-sectional view of the apparatus in FIG. 2 after expansion of the cylinder.

Referring to a modified form of the invention as shown in FIGS. 2 and 3, the flanges 3′ are held together by a head 14 formed on the shaft 13. A supporting plate 16 is applied to the end of the shaft 13 by means of screw threads 15. A plurality of hydraulic elements 17, 18 are connected between the supporting plate 16 and the adjacent flange 3′. During the stressing of the cylinder 1, fluid under pressure is applied to the interior 19 of the hydraulic elements 17, 18 to urge the adjacent flange 3′ toward the left, thereby counteracting the force due to the pressure in the interior of the cylinder 1. The hydraulic elements 17, 18 urge the flange 3′ against the end of the cylinder 1 as its length decreases during the expansion process. As the cylinder 1 expands radially under the pressure applied in the space between the interior of the cylinder and the shaft 13, the length of the cylinder decreases.

The expanded cylinder is illustrated in FIG. 3. The expanded cylinder 1 is thinner in cross-section and shorter in length. The flange 3′ has been replaced by a flange 3″ which has a larger central opening and a sleeve 20 is applied over the shaft 13 into the central opening in the flange 3″. The end of the sleeve 20 abuts the plate 16. The screw threads 15 on the shaft 13 permit the plate 16 to be displaced toward the left as viewed in FIG. 3 to compensate for the shorter length of the cylinder 1. The sleeve 20 reduces the axial force on the flange 3″. The several sleeves 20 of different thickness may used by replacing a thinner sleeve by a thicker sleeve as the cylinder 1 expands. Also, the sleeves 20 may be of a progressively greater internal diameter so that one sleeve may be applied over another sleeve to increase the total diameter of the combined shaft and sleeve.

While this invention has been illustrated and described in accordance with a preferred embodiment, with modifications, it is recognized that variations and changes may be made therein without departing from the invention as set forth in the claims.

I claim:

1. Apparatus for cold-working a cylinder comprising two flanges, each having a central opening, a shaft extending through both of said openings, means supporting said cylinder concentrically with said shaft and said openings of the flanges, the opposite ends of said cylinder being in sealing relation with said flanges, said shaft having a head on one end and a threaded portion at the other end, one of said flanges being positioned in abutting relation with said head and the other of said flanges being restrained from axial movement away from the one of said flanges by a support plate threadedly engaged on said screw threads of said shaft, and hydraulic cylinder means between said support plate and the other of said flanges.

* * * * *